US007070353B2

(12) United States Patent
Bostal

(10) Patent No.: US 7,070,353 B2
(45) Date of Patent: Jul. 4, 2006

(54) TOOTHBRUSH WITH A TOOTHPASTE CONTAINER AND A DOSING TRIGGER

(76) Inventor: Alberto Raul Bostal, Alsina 19, Piso 5 Oficina 3, 8000 Bahia Blanca, Prov. de Buenos Aires (AR)

( * ) Notice: Subject to any disclaimer, the term of this patent is extended or adjusted under 35 U.S.C. 154(b) by 69 days.

(21) Appl. No.: 10/828,845

(22) Filed: Apr. 20, 2004

(65) Prior Publication Data

US 2005/0002726 A1 Jan. 6, 2005

(30) Foreign Application Priority Data

Apr. 21, 2003 (AR) ..... P030101370

(51) Int. Cl.

| | |
|---|---|
| ***A46B 11/02*** | (2006.01) |
| ***A46B 11/04*** | (2006.01) |
| ***B43K 7/12*** | (2006.01) |

(52) U.S. Cl. ..... 401/188 R; 401/279; 401/278; 401/117

(58) Field of Classification Search ..... 401/188 R, 401/270, 278, 279, 117

See application file for complete search history.

(56) References Cited

U.S. PATENT DOCUMENTS 5,158,383 A * 10/1992 Glover et al. ..... 401/150
6,179,503 B1 * 1/2001 Taghavi-Khanghah ..... 401/184

* cited by examiner

*Primary Examiner*—David J. Walczak
(74) *Attorney, Agent, or Firm*—Andrew Wilford

(57) ABSTRACT

A toothbrush has an axially displaceable trigger at the upper end of a handle to force toothpaste into an extension provided with the brush and which is retractable in the hand.

4 Claims, 2 Drawing Sheets

TOOTHBRUSH WITH A TOOTHPASTE CONTAINER AND A DOSING TRIGGER

FIELD OF THE INVENTION

This application relates to a new toothbrush with a toothpaste container and a trigger which allows the spreading of a precise dose of paste onto the bristles when operated. This toothbrush is mainly designed for people who use this kind of utensil outside of home.

BACKGROUND OF THE INVENTION

When one wishes to use a regular or conventional toothbrush outside of home, it must be carried along with a toothpaste tube. The conventional tube is deformable, so that, when one takes the lid off and presses on the opposite end of the tube, the paste comes out to later be spread on the bristles.

The inconveniences of such a procedure outside of home are evident: it requires more space to carry the utensils; if taken inside a pocket, different pressures may produce an outflow of toothpaste, staining the garment or, even worse, the lid may be lost because of its size; it requires more time, more specific places and both hands free for dosing.

On the other hand, it's very well known that disposable objets are increasingly preferred, and it is desirable to be able to dispose of the toothbrush once the toothpaste is finished, giving the object a lifespan.

This problem has given rise to a large number of innovations: existing patents on the subject are uncountable. In terms of establishing the state of the art, and with no intention of being limiting, three contemporary different precedents will be mentioned here.

The United States patent U.S. Pat. No. 6,390,103 B1, dated May 21st, 2003, presents a set combining a toothbrush, toothpaste container, and a dental floss dispenser in a single unit with a main body, a head, a refill access part, and a base. The main body has a chamber designed to contain a certain amount of toothpaste. The head part holds the bristles to clean the user's teeth. Among the bristles there is a series of minute orifices selectively communicating with the toothpaste chamber. This product allows the refill of toothpaste by means of screwing a standard toothpaste tube onto the unit.

The United States patent U.S. Pat. No. 6,481,910 B1 is another invention of a toothbrush with a cylindrical handle which receives and stores toothpaste. By means of a twist on its end, the toothpaste is forced to move along a tubular canal toward the bristles. This end is detachable to allow the refill.

The United States patent U.S. Pat. No. 6,533,485 B1 is also a toothbrush invention with a long, hollow handle in which a certain amount of toothpaste has been stored and with a pressuring piston like device running along a longitudinal slot. Attached to this device there is a gauge or meter designed to indicate how much toothpaste is left in the chamber. The bristle head also has minute orifices in permanent communication with the cavity in the hollow handle.

As one can see, from the preceding art the devices all include a toothpaste deposit within the toothbrush handle, a tube or canal connecting the toothpaste chamber with the bristle head, minute orifices among the bristles and a device that ejects the toothpaste onto the bristles. However, all these devices have defective parts or concepts which the present invention solves.

Referring to the first example the brush is rechargeable, which means that the bristles, as well as the mounting system and materials, must be of good quality, since the brush is supposed to last several refills. This definitely increases its cost.

An identical problem is present in the second example, with the addition of not being able to handle the whole dosing process with just one hand.

In the third example, the toothbrush is disposable, but the quantity of toothpaste provided is small because its handle is thin. Thus, the product cost is low but its life span is short requiring the user to buy the product within shorter periods of time. This makes the product expensive from the user's point view.

In all of those known devices, toothpaste dosing must be carefully carried out by the user, since the process required to meter out the paste does not include a dosing trigger. This is not as easy to do as it seems, it requires concentration. The last end of paste chamber, by being exposed to the outside environment, may have dried out or contain low humidity toothpaste, especially if the toothbrush hasn't been used for several days. In this case the user may apply too much pressure onto the tube to force the dry paste to come out. Once the dry paste is overcome, however, the fluid paste, by being under pressure, may strongly be ejected from the chamber generating an overdose or, even worse, a spill.

Also, and finally, the toothbrushes here described as previous art, have the toothpaste container always exposed to the air through the minute orifices, generating the slow drying out of the paste.

BRIEF DESCRIPTION OF THE INVENTION

The toothbrush with a toothpaste container and a dosing trigger of the invention has in its lower end a hollow handle with the interior cavity divided, by means of a sliding stop device, into an intermediate chamber, designed to contain toothpaste, and a lower chamber containing air communicating with the outside environment by a minute orifice; the upper face of this intermediate chamber has a first valve communicating with a third chamber with varying volume formed by the interior of a hollow moving part, the trigger, and side walls extending the handle and providing a guide and a stop to the trigger. The trigger has an elastic repositioning device (spring) that, when still, maximizes the varying volume. This first valve is capable of allowing the passage of toothpaste only in the ascending direction when the pressure in the upper chamber is lower than the pressure in the intermediate chamber, which, in general terms, is substantially similar to the outside environment pressure (atmospheric pressure). The upper chamber communicates with the tubular canal within a protruding section substantially thinner than the lower section of the handle and as extending vertically this handle, carrying this extension, in its upper end, the bristles head in which the bristles are evenly distributed over the interior vertical face of the bristle head. The tubular canal has an orifice with a second valve in the center of the bristle head and among them. This valve allows the passage of toothpaste from such a canal, passage or channel to the bristles only when the pressure in the canal is higher than the ambient pressure, dosing the toothpaste when the user activates the trigger with his/her pointing finger, which generates an increase onto the toothpaste in the varying volume chamber and the tubular canal, opening the second valve. Upon deactivating of the trigger, a depressurizing in the trigger chamber occurs which closes the second valve and opens the first one, suctioning toothpaste from the intermediate chamber until the trigger returns to its rest position, while the sliding stop device slides towards the trigger chamber, finally closing the first and second valves.

In another alternative, the protruding or extending part substantially thinner than the handle is retractable, being introduced, by means of an axial movement, from its active position, in which the trigger chamber is communicated with the tubular canal, to its retracted non-operative position, where the trigger chamber is not communicated with the tubular canal within an additional cavity in the handle, where there is a means for sealing the contact points between the moving retractable part and the fix parts.

Even more, as an alternative of the previous one, such a protruding or extending retractable part has a lock to fix such a part in the operative, or active, position as well as in the retracted non-operative position.

In a preferred alternative, the handle has in its lower end a base, as a lid or cap, set in place by pressure, determining a restricted air passage from the outside environment into the minute orifice. A removable cover is also provided which sets in place by means of pressure onto the upper border or surface of the handle, covering the trigger, the protruding or extending part and the bristles head.

As a possible option to all previous alternatives it presents a removable cover which is set in place under pressure on to the upper border of the handle, covering the trigger, the protruding or extending retractable part and the bristles head when such a part is in the retracted non-operative position.

Another option, independent from the previous, within the lower chamber inside the handle there is an elastic device (spring) which cooperates in the upper movement of the sliding stop device.

ADVANTAGES OF THE PRESENT INVENTION

The most evident advantage, already stated, is that the device can be carried easily and safely. Another advantage one may list is that it is disposable, therefore, fabricated with inexpensive materials and techniques, allowing the user to buy it any place and any time when having forgotten to bring one from home or in case of running out of toothpaste. Moreover, dentists advise not to use toothbrushes over periods longer than three months; therefore, the use of a disposable toothbrush doesn't result in expenses when compared to the use of a conventional toothbrush.

Finally, the retractable options enhance the transportability of this toothbrush.

All these advantages have been taken as objectives or goals to be achieved by this invention.

Other objectives are: to allow precise application of toothpaste in terms of spreading it in the right place into the bristles, and with the right amount or quantity, thus preventing the excessive use of toothpaste, or even spilling it; to keep the toothpaste always fresh.

BRIEF DESCRIPTION OF THE DRAWING

To develop and achieve the advantages previously listed, to which users and specialists may add more, two examples will be described with the sole purpose of illustrating the invention. Sketches or schematic drawings are attached to better illustrate the description. Since these are examples they are not to he considered exclusive or limiting; on the contrary, they are intended to explicate and illustrate the basic concepts on which the invention is based. In the drawing:

FIG. 2 is valid for both examples presented in this invention.

SPECIFIC DESCRIPTION

References in all figures correspond to similar elements.

Figure 1:
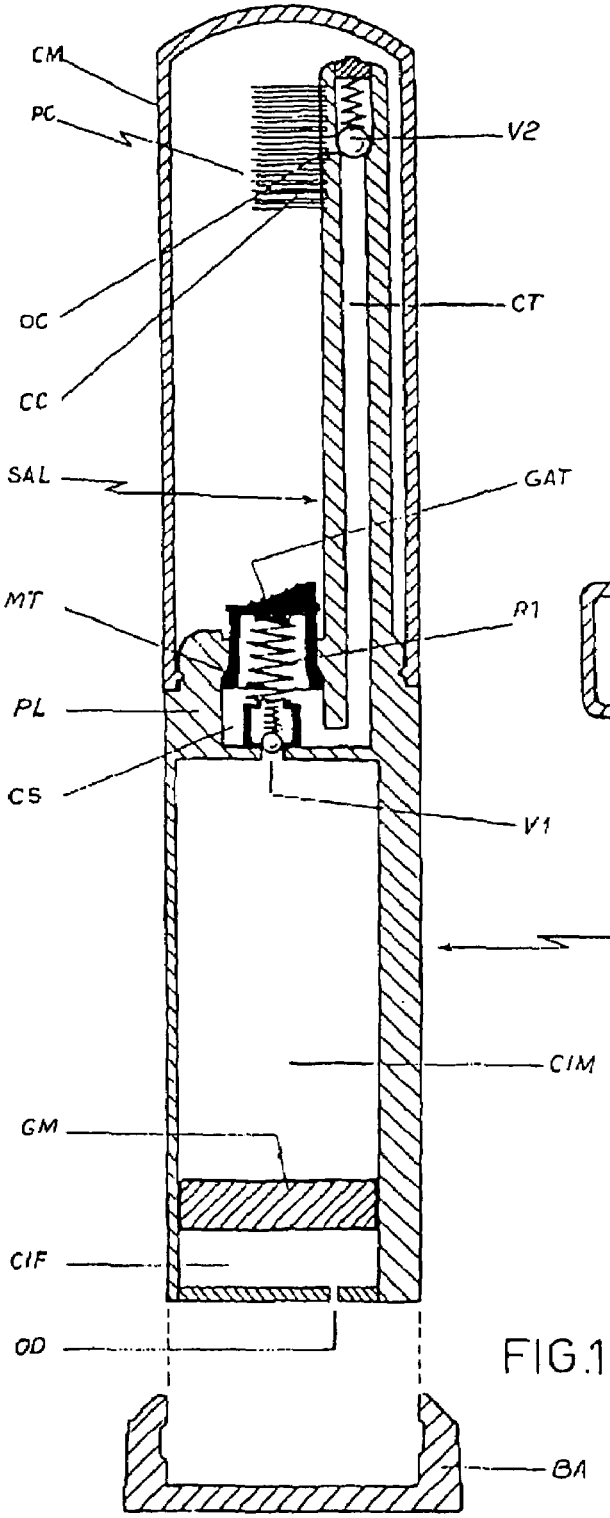
FIG. 1 shows a side view of a longitudinal section through the center of a non-retractable toothbrush, according to the present invention, as a first example.
Figure 2:
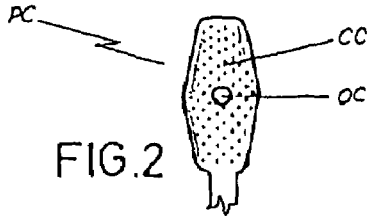
FIG. 2 shows a front view of only the bristle head, that is, facing the bristles, orthogonal from the position of the viewer in FIG. 1.
Figure 3:
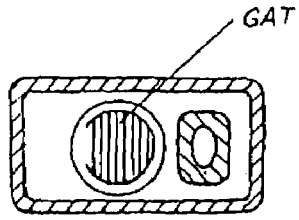
FIG. 3 shows a top view of a transversal section above the trigger and below the bristles head, with the cover on. The dosing trigger, the tubular canal and the cover can be appreciated in the figure.

About the first example, in FIG. 2, the protective cover has been removed.

As can be seen in all figures, "MH" is the hollow handle of the toothbrush, with an intermediate chamber "CIM", or toothpaste container, assumed to be filled in the factory, and as part of the fabrication process, and a lower chamber "CIF" with air at ambient pressure, both chambers divided by a piston, "GM", which moves tightly up or down along the cavity preventing the communication between both chambers. As the toothpaste is consumed the sliding stop device or piston will move upward, mainly because of the different pressures in both chambers: the air chamber (CIF) will always have ambient pressure while the toothpaste chamber (CIM) will vary its pressure in according to whether the toothbrush is being used or not. If the pressure unbalance is not sufficient to activate the system, to overcome friction or the toothpaste resistance, as well as the valve spring mentioned later, an elastic device or spring (not illustrated) may be included in the system, not to overcome by itself all the resistances but to help balance the pressures by moving the sliding stop device (GM) upward.

In the upper end of the toothpaste chamber (CIM) one finds the valve "V1", which allows the passage of toothpaste to the superior chamber "CS" when in the pressures decreases in it, becoming lower than the atmospheric pressure. The CS has a moving part to be activated by the user's pointing finger, while the rest of the hand holds the toothbrush handle. This part is called the trigger "GAT". In the drawn position, the trigger (GAT), by its form, sets on a surface MT because of the pressure of the spring "R1", which may be overcome by the pressure exercised with the finger. The chamber CS is enclosed by side walls "PL" as if these were extensions of the perimeter walls in the handle's cavity. However, this chamber communicates with the tubular canal inside the protruding or extending part topped by the bristle head "PC". Here one finds the bristles "CC" on one side of the head, and, in the center of that face, and among the bristles, the orifice "OC" through which the dosed toothpaste will come out. The paste passage through this orifice (OC) is normally blocked by spring loaded valve "V2", easily overcome when the pressure in the tubular canal (CT) increases.

Obviously, to use the toothbrush, the user must first remove the cover "CM" which provides hygienic protection to the bristle head. Then, taking the toothbrush by its handle and exercising pressure onto the trigger (GAT), an overpressure is inserted in the superior chamber (CS) and the tubular canal (CT), simultaneously closing valve "V1", and opening valve "V2", thereby allowing a precise quantity of paste to come out among the bristles in the bristles head.

When the trigger (GAT) is released, it moves back to its rest position by means of spring "R1", developing a low pressure in chambers "CS" and "CT", so that "V2" closes while "V1" opens. The sliding stop device moves upward as air comes into the air chamber "CIF" through the minute orifice "OD".

The dosing process is now finished. Now the toothbrush is ready to be used. Once used, the brush is cleansed and rinsed and the cover "CM" set in place protecting the bristles head, and the user's clothes. The toothbrush keeps its two valves closed. with no place for spill's and no risk of loss of toothpaste humidity.

The toothbrush is ready to be used fully functional in a few hours or even few days.

For a better presentation, a base "BA" may be included to set upright the toothbrush, providing that the minute orifice "OD" stays unblocked for the air passage.

Once the toothpaste is finished, the toothbrush will be cast out.

The second embodiment only differs from the first in that the protruding or extending part "SAL", is retractable, and can be extended from its non-operative, retracted, position (FIG. 4) to its "ready-to-use" position (FIG. 6) by simply pulling with the fingers. It's always necessary to remove the cover "CM" first.

Figure 4:
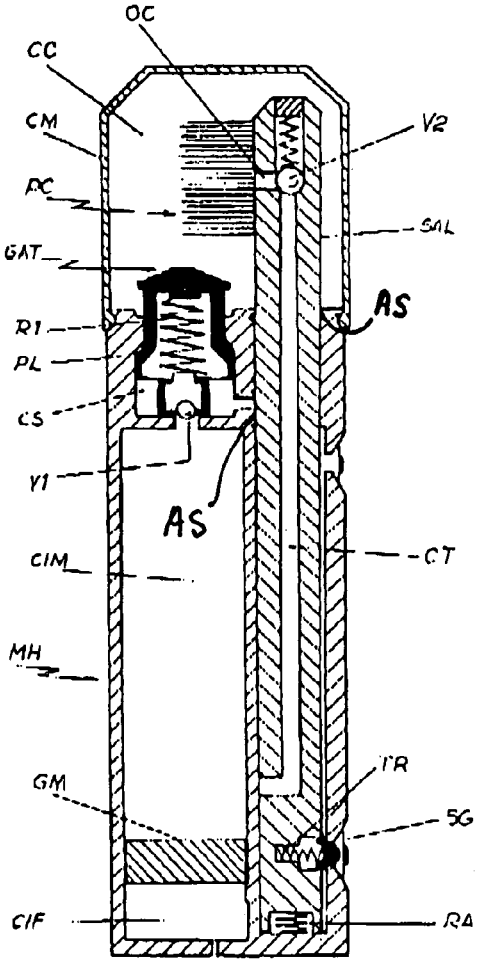
FIGS. 4 and 6 show, as a second example, a retractable toothbrush according to the present invention, showing in FIG. 4 the toothbrush in its non-operative position and in FIG. 6 the "ready-to-use" position.
Figure 5:
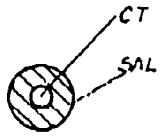
FIG. 5 shows a transversal section of the protruding or extending part (SAL) with the tubular canal. This Figure responds to both positions of the second example, the retractable toothbrush.
Figure 6:
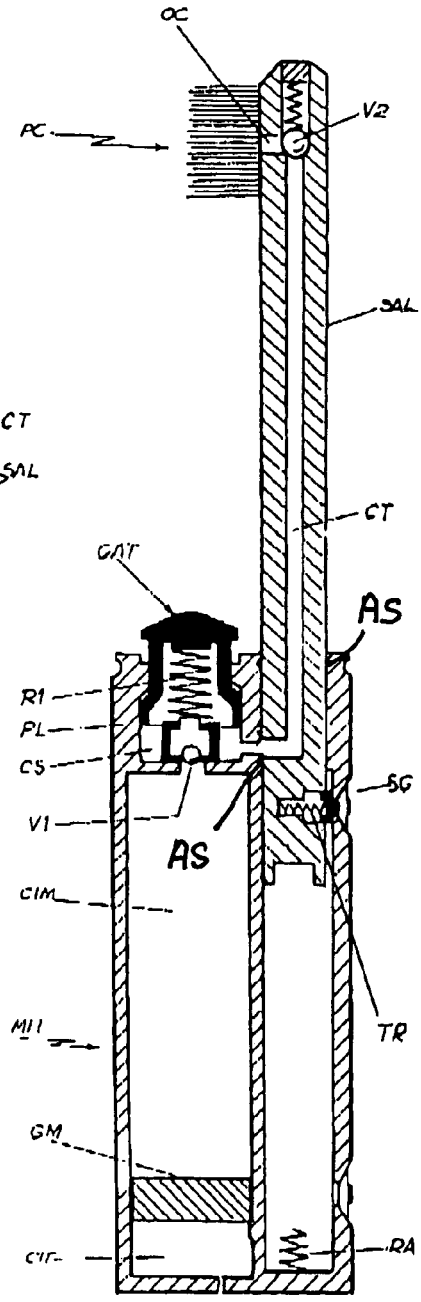

In order to allow a smooth movement of the retractable part "SAL" and, most important, to keep the system not exposed to air, o-rings "AS" are provided around "SAL", both, at the hollow handle "MH" top, and around the orifice connecting "CS" and "CT" cavities. As seen in FIGS. 4 and 6, this connection is only possible in the "ready-to-use" position.

Further, a spring "RA" is positioned in the handle "MH" which is compressed in the retracted position of the extending part "SAL".

In both cases the stop position points are determined and fixed by means of a lock with spring "TR", protected with a rubber seal "SG" in each locking point. In fabricating the toothbrush with a toothpaste container and a dosing trigger, alternatives or modifications may be introduced, being the right of protection of the present patent of invention defined and stated by the following vindicating clauses.

The invention claimed is:

1. A toothbrush comprising:

an elongated structure formed at a lower end with a hollow handle having an interior cavity;

a sliding piston in said interior cavity subdividing said interior cavity into an intermediate chamber above said piston and containing a supply of a toothpaste, and a lower chamber communicating with an exterior through a minute orifice;

a variable-volume upper chamber formed at an upper end of said hollow handle;

a spring-loaded first valve blocking flow of toothpaste from said upper chamber back into said intermediate chamber, but permitting flow of toothpaste from said intermediate chamber into said upper chamber upon a reduction in pressure in said upper chamber;

a trigger at the upper end of said hollow handle, manually displaceable generally axially thereon, and decreasing a volume of said upper chamber to displace toothpaste therefrom, said trigger having an elastic repositioning device in the form of a spring urging said trigger into a position corresponding to a maximum volume of said upper chamber;

a tubular extension axially retractible in said housing and axially extensible therefrom, said extension having:

a passage extending along a length thereof and communicating with said upper chamber in an extended position of said extension to receive toothpaste therefrom upon actuation of said trigger, said passage not receiving toothpaste from said upper chamber in a retracted position of said extension, a brush head at an end of said extension having a head orifice communicating between said passage and said brush for delivering toothpaste to bristles thereof, and a spring-loaded second valve at said head orifice to allow toothpaste to pass through said head orifice only when pressure in said passage is in excess of ambient pressure; and seals around said extension and at a location of communication between said upper chamber and said passage.

2. The toothbrush defined in claim 1, further comprising a lock to releasably fix said extension in said retracted position and said extended position.

3. The toothbrush defined in claim 2, further comprising a cover fitting onto an upper part of said handle and covering said head and said trigger.

4. The toothbrush defined in claim 1, further comprising a spring in said structure which is compressed in the retracted position of said extension.

* * * * *